United States Patent [19]

Robinson et al.

[11] Patent Number: 4,905,426

[45] Date of Patent: Mar. 6, 1990

[54] MOBILE SANDBLASTING APPARATUS

[75] Inventors: David Robinson, 218 Wright Avenue, Toronto, Ontario M6R 1L3, Canada; Tom L. Falkiner, Fort Erie, Canada

[73] Assignee: David Robinson, Canada

[21] Appl. No.: 351,488

[22] Filed: May 12, 1989

[30] Foreign Application Priority Data

May 13, 1988 [CA] Canada ..... 566707

[51] Int. Cl.[4] ..... B24C 3/06; B24B 1/00; B05B 3/06

[52] U.S. Cl. ..... 51/429; 239/255; 51/310

[58] Field of Search ..... 51/429, 428, 410, 431, 51/174, 175, 177, 165.77; 239/255, 256

[56] References Cited

U.S. PATENT DOCUMENTS 4,064,656 12/1977 Zeidler ..... 51/429
4,126,970 11/1978 Hockett ..... 239/255
4,139,969 2/1979 Brown ..... 51/165.77
4,255,906 4/1981 Hockett ..... 239/255
4,309,850 1/1982 Benson ..... 51/429
4,671,022 6/1987 Williams ..... 51/310

*Primary Examiner*—Frederick R. Schmidt
*Assistant Examiner*—Mark F. Frazier
*Attorney, Agent, or Firm*—Kane, Dalsimer, Sullivan, Kurucz, Levy, Eisele and Richard

[57] ABSTRACT

A mobile self-propelled apparatus for automatically progressively sandblasting over a surface, of the type having a platform upon which is mounted a swinging boom arm having a head at the end thereof to support a sandblasting nozzle. The swinging boom arm is mounted on a drive wheel driven by a first pneumatic cylinder for movement about the axis of the arm. A second pneumatic cylinder operates to cause the platform to move a predetermined distance on a supporting surface. Pneumatic control means are associated with the first and second pneumatic cylinder means so that the swinging of the arm is synchronized as desired with the movement of the platform.

6 Claims, 3 Drawing Sheets

FLOW CHART

MOBILE SANDBLASTING APPARATUS

BACKGROUND OF THE INVENTION

The present invention relates to a mobile self-propelled apparatus for progressively sandblasting over a surface.

Sandblasting of inanimate surfaces has conventionally been done by passing air from a compressor through an air line, into a sand pot holding sand, and then through a sand hose through a nozzle which is handled manually by a worker who directs the nozzle in an appropriate fashion against an appropriate area of the surface to be treated. Such a conventional method of sandblasting has many inherent disadvantages, including the fact that the clouds of silica dust generated in the vicinity of the surface being treated are quite harmful to the worker holding the nozzle. Also, the efficiency of the operation as well as uniformity of the treatment of the surface depend to a large degree upon the skill of the worker.

U.S. Pat. No. 4,255,906 to Hockett issued Mar. 17, 1981 describes and illustrates an abrasive cleaning apparatus, for sandblasting and the like, comprising a multi-nozzle head mounted on a swinging boom arm which is in turn supported on a mobile chassis. The boom arm pivots on the chassis about a vertical axis and about a horizontal axis. A winch mechanism provides linear advancement of the mobile chassis over a surface, controlled with the sweep of the swinging boom arm.

U.S. Pat. No. 4,126,970 to Hockett issued Nov. 28, 1978 describes and illustrates an abrasive cleaning apparatus of somewhat similar nature which is mounted on a mobile chassis but which is not self-propelled.

Other patents of background interest include Canadian Patent No. 1,114,170 of Neidigh et al., issued Dec. 15, 1981 (blast cleaning device for storage tanks comprising a wheeled travel car suspended from the sides of the tanks by means of a rigging), U.S. Pat. No. 4,309,850 to Benson issued Jan. 12, 1982 (portable sandblasting apparatus drawn on a truck along a desired path, with sandblasting nozzles reciprocating from side-to-side), U.S. Pat. No. 4,064,656 issued Dec. 27, 1977 (rail mounted swinging boom arm supporting a sandblasting nozzle), Canadian Patent No. 834,430 of Dye issued Feb. 17, 1970 (electrically controlled device for positioning a nozzle such as that of a sandblasting machine) and U.S. Pat. No. 4,139,969 to Brown issued Feb. 20, 1979 (apparatus for automatically controlling the feed rate or advancement of a grinding wheel into a workpiece).

It is an object of the present invention to provide an improved mobile self-propelled apparatus for automatically progressively sandblasting over a surface. It is a further object of the present invention to make such device, when operating, fully automatic and to run on energy from the air compressor used for supplying compressed air to the sandblasting nozzle.

SUMMARY OF THE INVENTION

In accordance with the present invention there is provided a mobile self-propelled apparatus for automatically progressively sandblasting over a surface of the type having a platform and a swinging boom arm having a head at the end thereof supporting a sandblasting nozzle. The arm is mounted on the platform for swinging movement about an axis through an arc in a plane between start and finish positions. Swinging boom arm control and actuation means drive the arm from start to finish position and return it from finish to start position. Wheel means support the platform for movement along a supporting surface. Means are provided to drive the wheel means a predetermined distance, coordinated with the movement of the swinging boom arm. In the apparatus according to the present invention, the swinging boom arm is mounted on a drive wheel driven by first pneumatic cylinder means for movement about the axis of pivoting of the arm. Second pneumatic cylinder means are associated with the means to drive the wheel means so that when the second pneumatic cylinder means is actuated, it rotates the wheel means a predetermined amount and thereby causes the platform to move a predetermined distance on the supporting surface. Pneumatic control means are associated with the first and second pneumatic cylinder means so that the movement of the swinging boom arm is synchronized as desired with the rotation of the wheel means.

In a preferred embodiment of the present invention, a common pneumatic source feeds the first and second pneumatic cylinder means and the sandblasting nozzle. As well, the means to drive the wheel means is a one-way drive ratchet associated with an axle of the wheel means. The ratchet has a handle to which the shaft of the second pneumatic cylinder means is associated so that, on the drive stroke of the second pneumatic cylinder means, the handle of the ratchet means is pivoted about the axis of the axle of the wheel means to turn the wheel means.

The apparatus according to the present invention is particularly useful when the plane of the arc through which the arm moves is parallel to that of the platform. It may be used in sandblasting bridges and the like as is required when they are being constructed or repaired, prior to further treatment of the surface, for example by the application of waterproofing coatings and layers of asphalt or cement. The apparatus of the present invention derives all of the energy required to run it from an air compressor. It is extremely efficient in operation since each stroke of the swinging boom arm may be a perfect reproduction of the previous stroke at a predetermined linear distance along a surface being treated. In this manner there is a minimum overlap between strokes, optimizing the usage of sand.

BRIEF DESCRIPTION OF THE DRAWINGS

These and other objects and advantages of the invention will become apparent upon reading the following detailed description and upon referring to the drawings in which.

Figure 1:
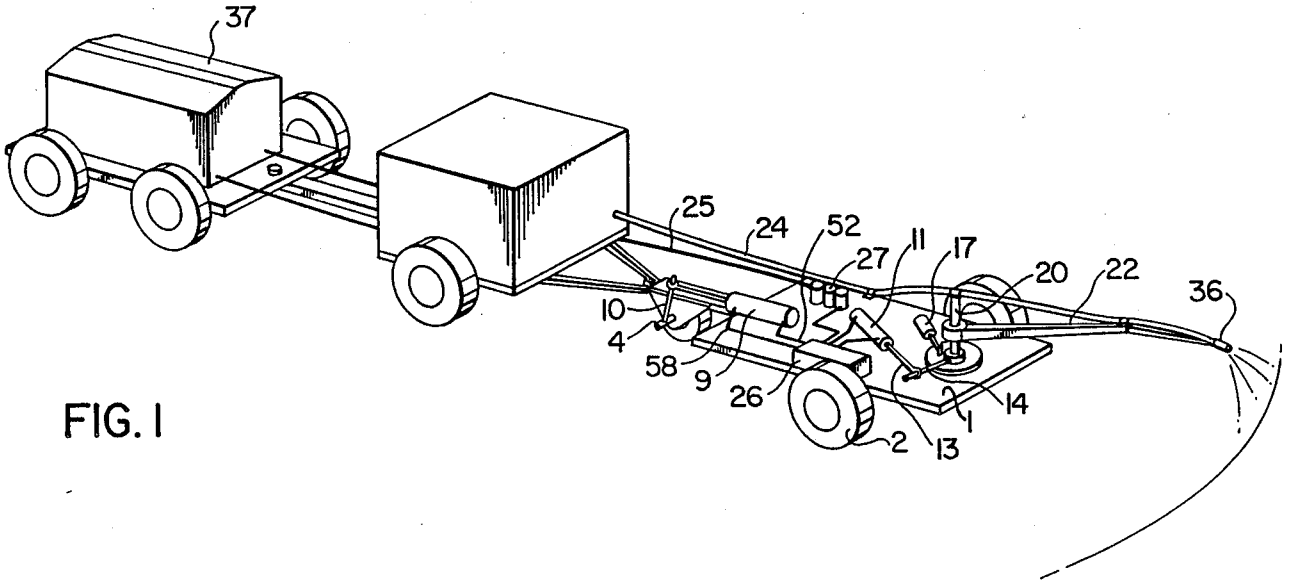
FIG. 1 is a perspective schematic view of a sandblasting apparatus in accordance with the present invention.
Figure 2:
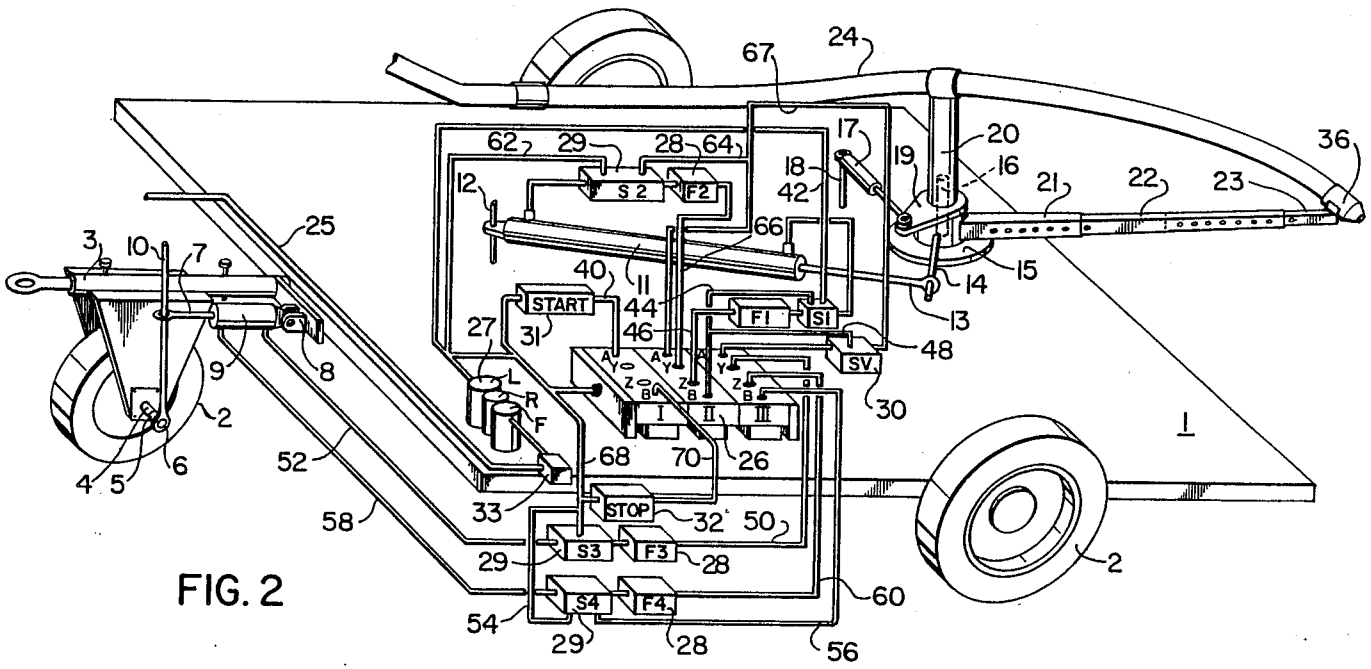
FIG. 2 is a schematic diagram of the pneumatic controls and piping of the apparatus of FIG. 1.
Figure 3:
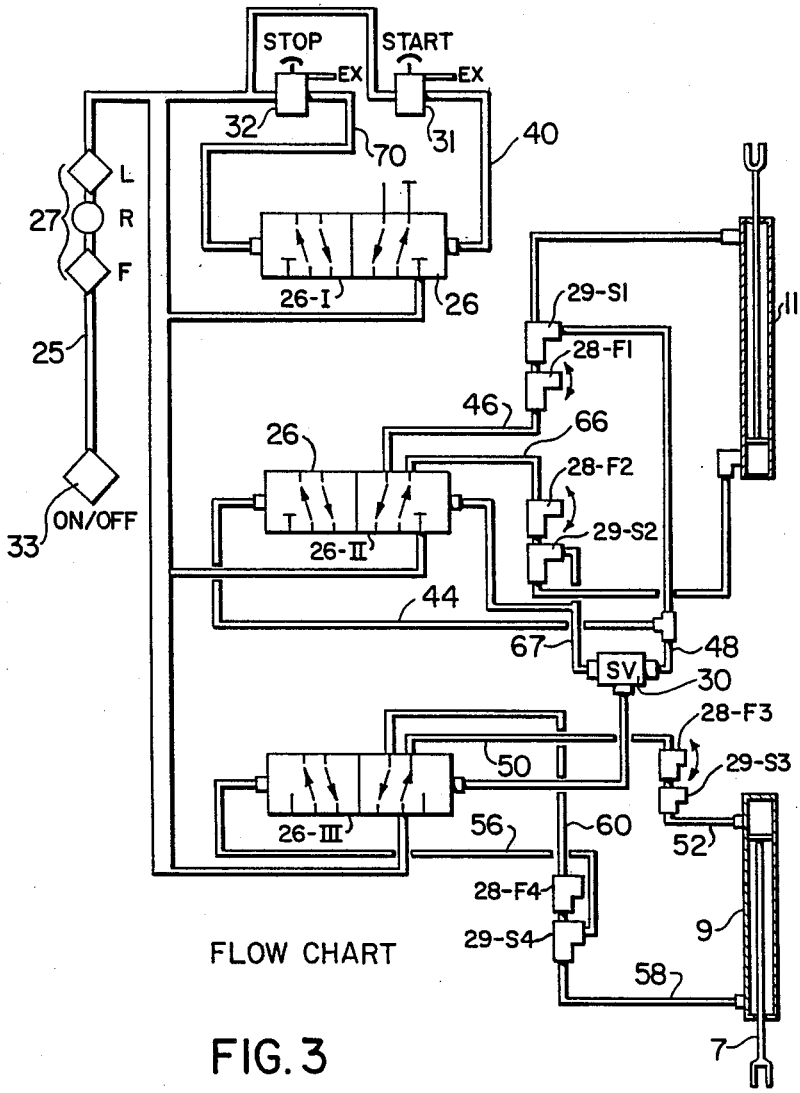
FIG. 3 is a flow chart illustrating the operation of the pneumatic valves of the device of FIG. 1.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Turning to FIG. 1 there is illustrated a mobile self-propelled apparatus in accordance with the present invention, which has been built for sandblasting but, as will be described hereinafter, is easily adapted for other uses. As can be seen in FIG. 1 the device comprises a platform 1 supported on tires 2. At the front is a pipe 3 to which the drive assembly is fastened, intended to rotate 180° for transport. An axle 4 is welded to the front wheel, which wheel is mounted on support plates with bearings as illustrated. A socket 5 is welded to the end of the axle of this front wheel and a ratchet 6 with an extended handle 10 is adjustably fastened to the end of the shaft 7 of a pneumatic cylinder 9. Cylinder 9 as illustrated drives ratchet handle 7 to turn the front wheel 2. Means may be provided (not illustrated) such as holes in the ratchet handle to receive different arrangements or hookups of cylinder 9 which is accordingly pivotably secured to platform by clamp 8.

A second pneumatic cylinder 11 is mounted on platform 1, its base being secured to a post 12 attached to platform 1 for swivel movement as illustrated. The end of shaft 13 is attached to a connecting rod 14 for swivel movement of a rotor 15, which rotor is mounted on a spindle 16 for pivotal movement of rotor 15 about a vertical axis, on spindle 16. Rotor 15 is also attached to a shaft of an hydraulic damper 17, the other end of which damper 17 is mounted on a post 18 (secured to platform 1) for swivel movement. Damper 17 is connected to rotor 15 by way mounting bracket 19 as illustrated.

Extending upwardly from rotor 15 is a mast 20. Outwardly extending from rotor 15 is a telescopic mast hookup 21 with telescopic pipe 22 cooperating therewith. At the far end of telescopic pipe 22 is a telescopic pipe 23 with a nozzle bracket to receive and aim nozzle 36 at the end of sand hose 24. Pneumatic cylinders 9 and 11 operate by means of air fed by incoming air line 25. The source of air feeding air line 25, as well as that feeding sand hose 24, would normally and preferably be the same, e.g. a compressor 37 (FIG. 1) at the job site. Control valves 26 switch air flows along appropriate lines, for air from incoming air line 25. That incoming air is passed through an air filter, pressure regulator and oiler at 27. Flow control switches 28 (F1, F2, F3 and F4) and sensor switches 29 (S1, S2, S3 and S4) operate, as will be described in more detail hereinafter, to cause the swinging boom arm formed by telescopic mast hookup 21 with its telescopic sections 22 and 23, to pivot through an arc in a plane parallel to that of platform 1 while synchronizing that movement with the movement of platform 1 brought about by the operation of ratchet 6 on socket 5 welded to axle 4. Shuttle valve 30, start switch 31, stop switch 32 and on/off switch 33 for incoming air, additionally are part of this system.

In operation, air flow through pipe 25 is commenced by turning switch 33 "on". Moisture from that air is taken out, the pressure set, and oil added, at 27.

This air then primes the sensors 29 (S1, S2, S3 and S4), as well as stop switch 32. As well, this air flows into the pneumatic control valve 26 designated as "I", exhausting from port Z.

When start switch 31 has been primed and the start button (not shown) associated therewith is pushed, signal pressure goes through line 40 into control valve 26 designated as "II", through port A. An air actuated plunger (not illustrated) within this control valve is moved by air pressure to a next position therein, which allows air to pass into control valve 26-II. Air pressure then leaves control valve 26-II, port Y, and travels flow control 28-F2 and sensor switch 29-S2 into the base of cylinder 11. That pressure causes the cylinder shaft 13 to extend, causing the boom (telescopic pipes 21, 22 and 23) to swing to the left.

When shaft 13 of cylinder 11 has fully extended, this creates a lack of pressure on sensor switch 29-S1, which, sensing a lack of constant pressure, allows air from pipe 42 to flow into control valve 26-II, through port B, by means of signal line 44. Signal pressure in control valve 26-II causes a plunger within (not illustrated) to slide to its next position which then allows air to leave that control valve through line 46 from port Z, through flow control 28-F1 and sensor switch 29-S1, and into the front of cylinder 11, thereby causing cylinder shaft 13 to contract and consequently the boom (pipes 21, 22 and 23) to swing back to the right.

While the signal pressure in line 44 is progressing into control valve 26-II, port B, it branches at line 48 and travels through shuttle valve 30 which delivers signal pressure to control valve 26-III, hole A. This pressure slides the plunger within control valve 26-III (not illustrated) to the next position which allows air to flow out via line 50, through flow control 28-F3 and sensor switch 29-S3, through line 52 into the base of cylinder 9. This action causes the cylinder shaft 7 of cylinder 9 to extend, causing the ratchet 6 to be turned a predetermined distance in its drive position, thereby turning the front wheel 2 and causing the trailer platform 1 to advance a predetermined distance dependent upon the length of the stroke of shaft 7.

Sensor switch 29-S4 allows pressure from line 54 to continue along line 56 after that switch has noticed the change in the pressure of line 58 from the completion of the extending stroke of cylinder 9. The signal pressure in line 56 enters control valve 26-III at port B. This pressure causes the plunger within (not illustrated) to slide to its next position, thereby allowing pressure to leave control valve 26-III via port Z and line 60, through flow control 28-F4 and sensor switch 29-S4 into the front end of cylinder 9, thereby causing cylinder shaft 7 to contract. The ratchet 6 on the axle 4 of front wheel 2, associated with the shaft of cylinder 9, drives this axle and wheel only on the extending stroke of cylinder 9, thereby synchronizing the movement of platform 1 and wheels 2 to a time when the boom (pipes 21, 22 and 23) is swinging to the right (on the contracting stroke of shaft 13).

When sensor 29-S2 senses a lack of constant pressure caused by the completion of the contracting stroke in cylinder 11, it allows air in line 62 to continue along line 64 into control valve 26-II, port A. This pressure causes the plunger within control valve 26-II to slide to its first position, thereby allowing air to escape via line 66 through flow control 28-F2 and sensor switch 29-S2, thereby cutting off air passage from line 62 through sensor switch 29-S2 to line 64, into the base of cylinder 11, causing the shaft to extend and the boom to swing to the left again as previously described herein.

At the same time as signal pressure from line 64 is entering control valve 26-II, port A, air in line 64 branches off to line 66, to travel through shuttle valve 30 and into control valve 26-III, port A. This causes the plunger within control valve 26-III to slide to its first position allowing air to escape through port Y in control valve 26-III, and line 50, thereby causing cylinder 9 to repeat its cycle. This back and forth motion of the boom and synchronized forward motion of platform 1 will continue on its own until incoming air is turned off or the stop switch 32 is engaged, at which time the air pressure in line 68 is allowed to pass through the stop switch 32, through line 70, into control valve 26-I, port B. This action causes the plunger within control valve 26-I to slide to its first position, allowing free passage of air through control valves 26-I, II and III, and exhausting out of control valve 26-I, port Z.

It will be appreciated that the apparatus of the above-described construction and operation provides a mobile, self-propelled machine which is suitable for sandblasting. It is understood however that this device is easily adapted for other uses where compressed air is involved, such as spray painting and the like. Of course the present invention is intended to include such other uses.

The synchronized control of the swinging boom and drive wheel in the illustrated embodiment produces a precise stroke across a horizontal plane. It will be readily appreciated by one skilled in the art however that the apparatus illustrated in the figures can be readily adapted for vertical, diagonal or overhead applications. The apparatus according to the present invention creates a precise coverage of the work surface. The combination of flow controls and boom adjustability, and the adjustable linkage of piston 9 to ratchet 6 driving drive wheel 2, makes for a wide variety of stroke widths, depths of working for each stroke, and speeds.

The device according to the present invention is much faster than manual sandblasting, and provides for a more precise sandblasting stroke, with consequently less sand used. Since the device is virtually automatic, the operator is kept free from harmful silica dust. It is powered solely by existing energy, in that the compressor which drives it is already required for the sandblasting operation. The control valves 26, flow controls 28 and sensor switches 29, as well as the other valves and switches required in this apparatus, may be completely encased and sealed so that they are not affected by dust or other free-flying contaminates.

Thus it is apparent that there has been provided in accordance with the present invention a mobile self-propelled apparatus for automatically progressively sandblasting over a surface that fully satisfies the objects, aims and advantages set forth above. While the invention has been described in conjunction with a specific embodiment thereof, it is evident that many alternatives, modifications and variations will be apparent to those skilled in the art in light of the foregoing description. For example, any appropriate conventional steering mechanism may be added for wheels 2, with an appropriate steering control, to enable the movement of platform 1 in a non-linear direction while operating. Accordingly, it is intended to embrace all such alternatives, modifications and variations as fall within the spirit and broad scope of the invention.

What we claim as our invention:

1. In a mobile, self-propelled machine apparatus for automatically progressively sandblasting over a surface comprising a platform, a swinging boom arm having a head at the end thereof supporting a sandblasting nozzle, the arm mounted on the platform for swinging movement about an axis through an arc in a plane between start and finish positions, swinging boom arm control and actuation means to drive the arm from start to finish position and return it from finish to start position, wheel means supporting the platform for movement along a supporting surface, and means to drive the wheel means a predetermined distance coordinated with the movement of the swinging boom arm, the improvement characterized by the swinging boom arm being mounted on a drive wheel driven by first pneumatic cylinder means for movement about the axis of pivoting of the arm, second pneumatic cylinder means associated with the means to drive the wheel means so that when the second pneumatic cylinder means is actuated, it rotates the wheel means a predetermined amount and thereby causes the platform to move a predetermined distance on the supporting surface, and pneumatic control means associated with the first and second pneumatic cylinder means so that the movement of the swinging boom arm is synchronized as desired with the rotation of the wheel means.

2. An apparatus according to claim 1 wherein the pneumatic control means is associated with the first and second pneumatic cylinder means so that after the swinging boom arm is swung from start to finish position and before such swing is repeated, the second pneumatic cylinder means is actuated to drive the wheel means said predetermined amount.

3. An apparatus according to claim 2 further comprising a common pneumatic source to feed the first and second pneumatic cylinder means as well as the sandblasting nozzle.

4. An apparatus according to claim 1 wherein the plane of the arc through which the swinging boom arm moves is parallel to that of the platform.

5. An apparatus according to claim 1 wherein the means to drive the wheel means is a one-way drive ratchet means mechanically associated with the wheel means, the ratchet means having a handle to which the shaft of the second pneumatic cylinder means is associated so that, on the drive stroke of the second pneumatic cylinder means, the handle of the ratchet means is pivoted to turn the wheel means.

6. An apparatus according to claim 1, 3 or 4 wherein sensor means are associated with the first and second pneumatic cylinder means to indicate when these cylinder means are each near the ends of their strokes, the sensor means being associated with a pneumatic switch means to control the flow of air to the first and second pneumatic cylinder means.

* * * * *